US006986236B2

(12) United States Patent
Schneider et al.

(10) Patent No.: US 6,986,236 B2
(45) Date of Patent: Jan. 17, 2006

(54) HORIZONTAL FORM, FILL AND SEAL MACHINE FOR LOOSE FITTING PACKAGES

(75) Inventors: John H. Schneider, Frankfort, IL (US); Stanley Piotrowski, Schiller Park, IL (US); Nigel Knight, Kankakee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/830,143

(22) Filed: Apr. 21, 2004

(65) Prior Publication Data

US 2004/0194429 A1 Oct. 7, 2004

Related U.S. Application Data

(62) Division of application No. 09/885,211, filed on Jun. 20, 2001, now Pat. No. 6,745,545.

(51) Int. Cl.
*B65B 9/06* (2006.01)
*B65B 61/18* (2006.01)

(52) U.S. Cl. ..... 53/412; 53/450

(58) Field of Classification Search ..... 53/450, 53/550, 412, 133.4

See application file for complete search history.

(56) References Cited

U.S. PATENT DOCUMENTS 2,747,346 A * 5/1956 Tigerman et al. ..... 53/450
3,057,129 A * 10/1962 Meissner ..... 53/450
3,532,516 A * 10/1970 Erekson ..... 53/450
3,807,125 A * 4/1974 Enrich ..... 53/450
4,127,976 A * 12/1978 Jablonski et al. ..... 53/450
4,216,638 A * 8/1980 Yoshida ..... 53/550
4,587,794 A * 5/1986 Kopp ..... 53/550
4,592,193 A * 6/1986 Gustavsson ..... 53/550
4,679,379 A * 7/1987 Cassoli ..... 53/450
4,876,842 A * 10/1989 Ausnit ..... 53/450
4,956,963 A * 9/1990 Johnson ..... 53/450
4,958,477 A * 9/1990 Winkler ..... 53/550
4,970,846 A * 11/1990 Leino ..... 53/550
5,109,654 A * 5/1992 Suga ..... 53/550
5,255,495 A * 10/1993 Kovacs ..... 53/550
5,408,806 A * 4/1995 Lin et al. ..... 53/550
5,564,261 A * 10/1996 Kiner ..... 53/450
6,119,435 A * 9/2000 Fujiwara et al. ..... 53/389.3
6,131,369 A * 10/2000 Ausnit ..... 53/412
6,393,804 B1 * 5/2002 Ausnit ..... 53/412

* cited by examiner

*Primary Examiner*—John Sipos
(74) *Attorney, Agent, or Firm*—Pitney Hardin LLP

(57) ABSTRACT

A horizontal form, fill and seal machine has a hollow forming box into which a continuous film is longitudinally fed from a packaging film supply. The forming box has a top, sides and open inlet and outlet ends. A pair of guide bars extend from the outlet end of the forming box adjacent the forming box sides and extending away from the inlet end. The forming box transforms the flat packaging film into a film envelope that extends about the guide bars and has a product-receiving surface that rests on a conveyor between the guide bars. Sealing bars are provided to join the longitudinal edges of the packaging film together and to form seals across the envelope at package length intervals after each deposit of product onto the product-receiving surface. A zipper attaching mechanism applies zipper to the film upstream of the forming box.

7 Claims, 4 Drawing Sheets

HORIZONTAL FORM, FILL AND SEAL MACHINE FOR LOOSE FITTING PACKAGES

CROSS-REFERENCE TO RELATED APPLICATIONS

This application is a division of U.S. patent application Ser. No. 09/885,211, filed on Jun. 20, 2001, now U.S. Pat. No. 6,745,545, the disclosure of which is incorporated herein by reference.

BACKGROUND OF THE INVENTION

The present invention relates to reclosable packaging and, in particular, to an apparatus for horizontally forming, filling and sealing such packages to loosely fit about a packaged product.

Horizontal form, fill and seal (HFFS) machines are commonly used for packaging block-shaped products such as chunks of cheese, cheese slices or various products that are contained in a tray such as cookies and crackers. The package is formed of a flat sheet of plastic film onto which the product is deposited. One or both side portions of the sheet are wrapped over the product, the sheet side edges are sealed together and transverse seals are formed to complete the package about the product. A zipper may be provided for the package between the sheet edges or in a fold formed in the film in order to render the package reclosable after it is initially opened through the zipper. U.S. Pat. Nos. 4,589,145; 5,247,781 and 6,138,436 are representative of such prior art HFFS machines.

The packages formed on such machines are generally tightly pulled over the product during the wrapping operation for package aesthetics and in order to maintain constant width for the final packages. That is, if the film is not pulled at least semi-tight over the product, the width of the final packages tends to vary from package to package. Further, unless the film is pulled at least semi-tight the film may wrinkle during the package formation. These may cause consumer acceptance problems as well as difficulties in packing the packaged product. However, for certain applications, it may be desirable not to have the packaging film tight against the product. For example, a loose package permits easier removal of the package contents and facilitates returning product to the package. Also, where the package is to be provided with a fitment such as a spout or a zipper and, particularly with a slider activated zipper, a tight fit between the package and product may place undo stress on the package and interfere with the operation of the zipper. Also, where a tamper evident seal is provided inboard of the zipper, the consumer may find it difficult to rupture the seal when the product is tight against the seal.

SUMMARY OF THE INVENTION

In view of the above, it is the principal object of the present invention to provide a HFFS machine which forms uniform loosely fitting packages about the products to be packaged therein.

A further object is to provide such a machine that may be formed without modification of the major portions of conventional HFFS machines and which operates generally in the same manner as conventional HFFS machines.

The above and other objects and advantages are attained in accordance with the present invention by providing a horizontal form, fill and seal machine having a hollow forming box into which a continuous film is longitudinally fed from a packaging film supply. The forming box has a top, sides and open inlet and outlet ends. A pair of guide bars adjacent the forming box sides extend through the forming box beyond the outlet end of the forming box. A slit conveyor is provided extending longitudinally between the guides. The interior of the forming box is contoured to guide the packaging film to flow adjacent the top, down the sides, about the guide bars and onto the conveyor thereby forming a film envelope moving along the conveyor. The front ends of he guide bars may be tapered upwardly to generally follow the contours of the forming box.

The conveyor extends generally horizontally and the forming box is inclined with respect to the conveyor so that product may be fed through the forming box and into the film envelope so that the package formation may be completed about the product. After the envelope clears the free ends of the guide bars, cross seams are formed in the envelope at the leading and lagging ends of the product to complete the package about the product. A zipper may be attached to the film prior to feeding the film into the forming box.

DETAILED DESCRIPTION OF THE PREFERRED EMBODIMENT

Figure 1:
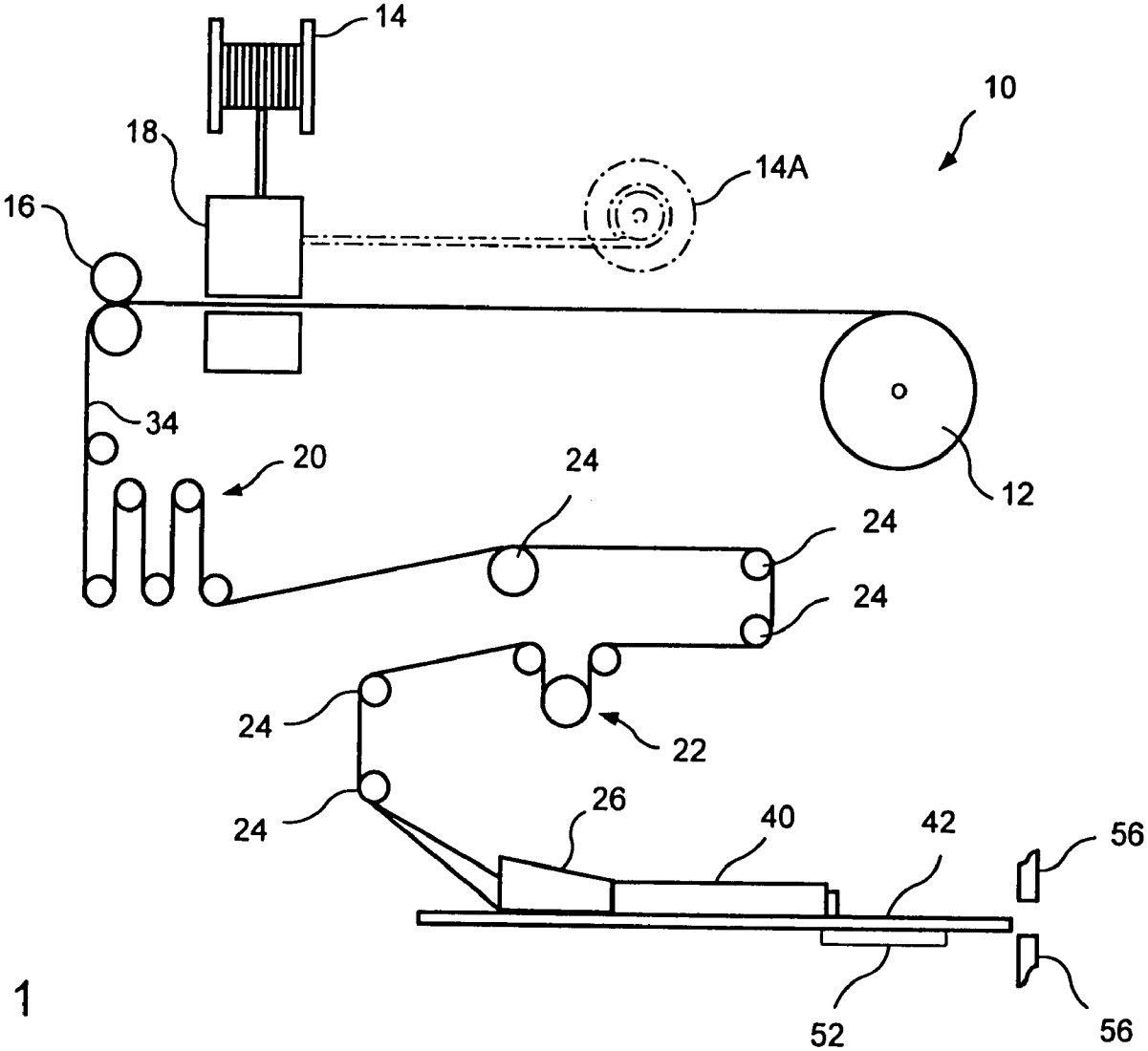
FIG. 1 is a simplified side, elevational schematic view of the horizontal form, fill and seal machine of the present invention.

Reference is now made to the drawings and to FIG. 1 in particular wherein a schematic representation of the form, fill and seal machine 10 of the present invention is depicted as comprising a supply of packaging film 12 and a supply of zipper 14. The film is drawn by drive rollers 16 through a zipper attaching mechanism 18 where discrete sections of zipper are applied transversely across the film at spaced intervals. The zipper may contain a slider or be slider-less. Such zipper attaching mechanisms are commercially available under the trade name TOP ZIP from the AMI/RecPro division of ITW Inc., located in Atlanta Ga. It suffices to say for the present that the zipper applicator 18 attaches a section of zipper that is approximately equal in length to one half the width of the packaging film to a center section of the film leaving margins on both sides of the film web without zipper.

Alternatively the zipper may be applied to the film longitudinally (i.e. in the film running direction rather than transversely across the film) by utilizing a zipper supply 14A as shown in phantom in FIG. 1 and changing the orientation of the seal bars of zipper attaching mechanism 18 accordingly. In this instance it may be desirable to slit the film longitudinally and seal the zipper to the film edges created by the slit.

Whether the zipper is applied transversely or parallel to the film running direction, the handling of the film and attached zipper is substantially the same. The film and attached zipper 34 are fed through a dancer system 20 by a drive 22 through guide rollers 24 to a forming box 26. The guide rollers 24 serve to orient the web so that the zipper is on the under surface of the web as it enters the forming box 26.

Figure 2:
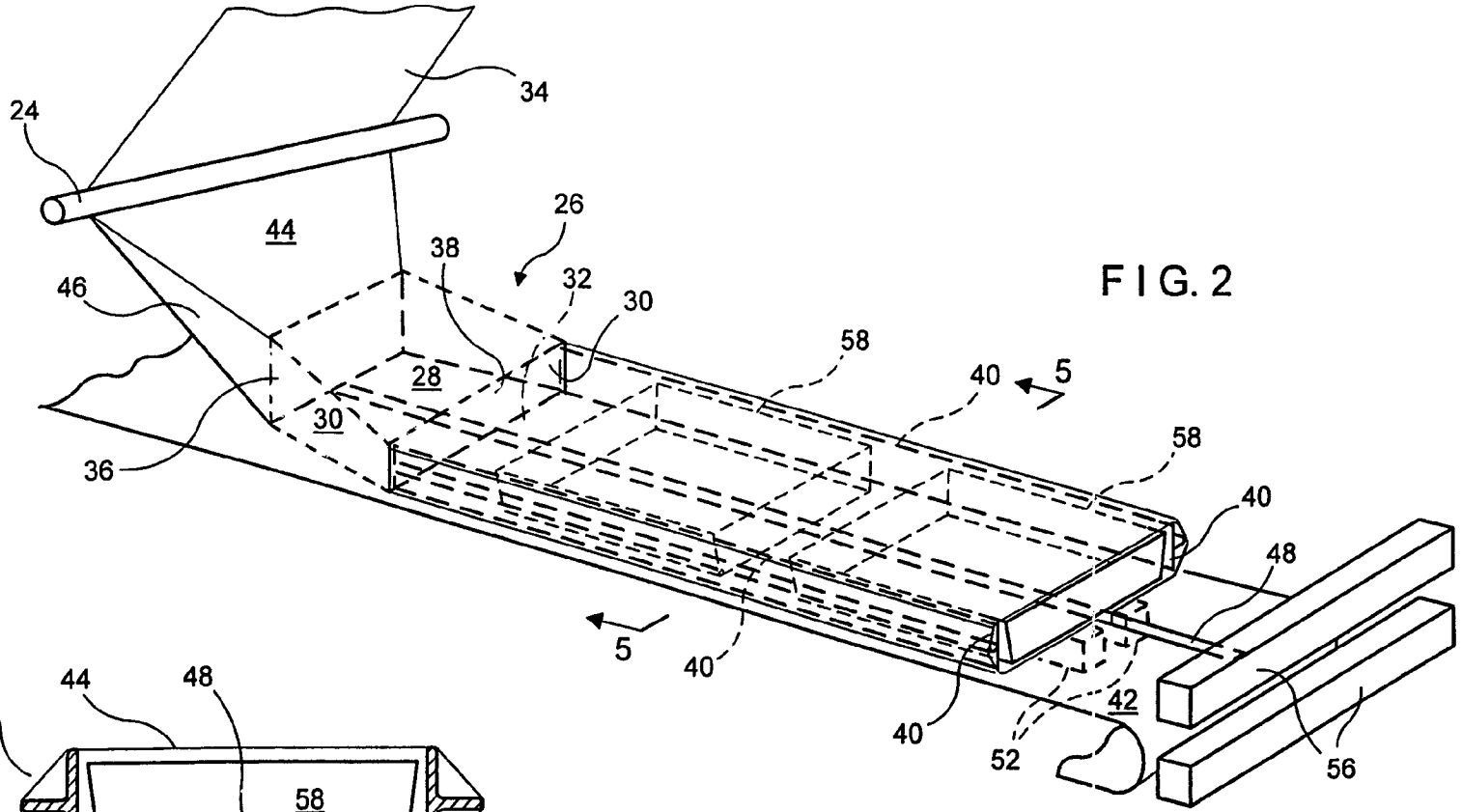
FIG. 2 is a perspective view of the forming box section of the horizontal form, fill and seal machine.

Referring to FIG. 2, it can be seen that the forming box 26 includes a top wall 28, opposed side walls 30 and bottom wall 32. The film with attached zipper 34 is fed into the open inlet end 36 of forming box 26 and exits the open outlet end 38. Guide bars 40 extend from the side walls 30 through the outlet end away from the inlet end. A horizontal conveyor 42 is positioned between the guide bars 40.

In the forming box the film with attached zipper 34 is guided by internal surfaces of the forming box and external surfaces of the guide bars so that a center portion 44 of the web follows the top of the forming box. The marginal side portions 46 of the web are guided about the guide bars 40 that extend into the forming box and onto the conveyor 42 to form a product receiving film surface 54 on the conveyor. The opposed longitudinal edges 50 of the film are fed into a slit 48 formed in the conveyor. A pair of longitudinally extending sealing bars 52 are positioned under the conveyor on opposite sides of the slit. A second pair of seal bars 56 is provided down stream of the downstream end of the conveyor extending transversely to the conveyor. Alternatively the film could be fed about the forming box and the guide bars adjusted accordingly.

In operation a flat packaging film 12 is fed through the zipper applicator 18 where the discrete sections of zipper 14 are applied to the packaging film at spaced intervals. The film 34 with applied zipper is oriented so that the zipper faces downwardly and is fed into the forming box 26. In the forming box the packaging film is guided so that the zipper bearing center portions follows the internal surfaces of the forming box top while side margin portions are trained about the forming bars and onto the conveyor surface with the longitudinal edges of the film passing through the conveyor belt slit. The conveyor belt is generally horizontal and the forming box is inclined with respect to the conveyor so that product 58, gravity fed through the forming box, is deposited onto the product receiving surfaces 54 of the film that sit on the conveyor. As a section of product bearing formed film passes the longitudinal sealing bars 52, the edges of the film are sealed together forming a closed envelope about the product. The envelope is then moved longitudinally beyond the free ends of the guide bars 40 to the conveyor end where the transverse sealing bars 56 are located. As each product bearing section passes through, the seal bars are actuated to seal the top of the envelope to the bottom of the envelope. In the transverse sealing process, the attachment of the zipper 14 is completed and a seal is formed at the zipper end 60 of the package 64. At the same time the end seal 62 for the opposite (non-zipper) end of the next package is formed.

Figure 5:
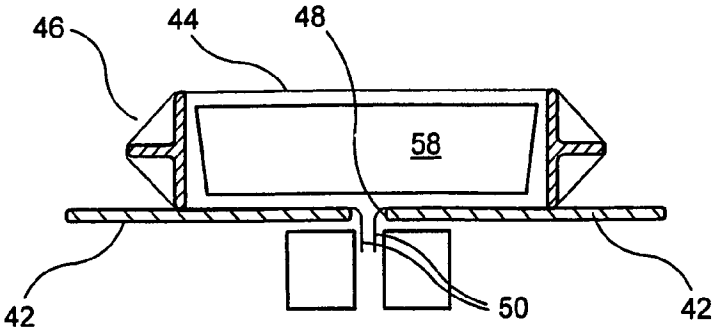
FIG. 5 is a sectional view taken along lines 5—5 of FIG. 4.
Figure 3:
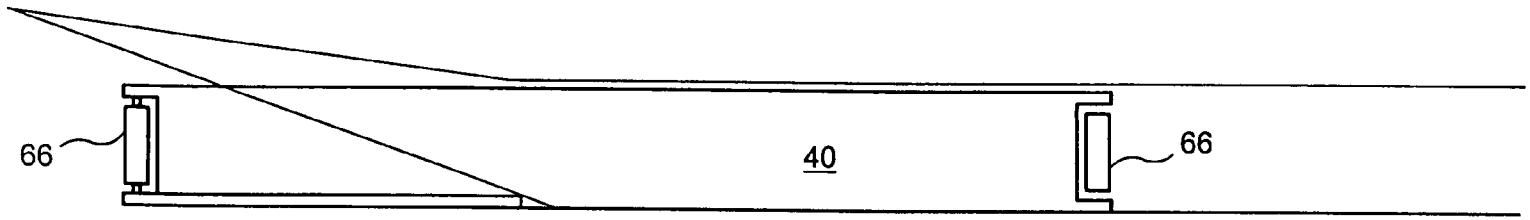
FIG. 3 is a fragmentary side elevational view of the guide bars of the horizontal form, fill and seal machine.
Figure 4:
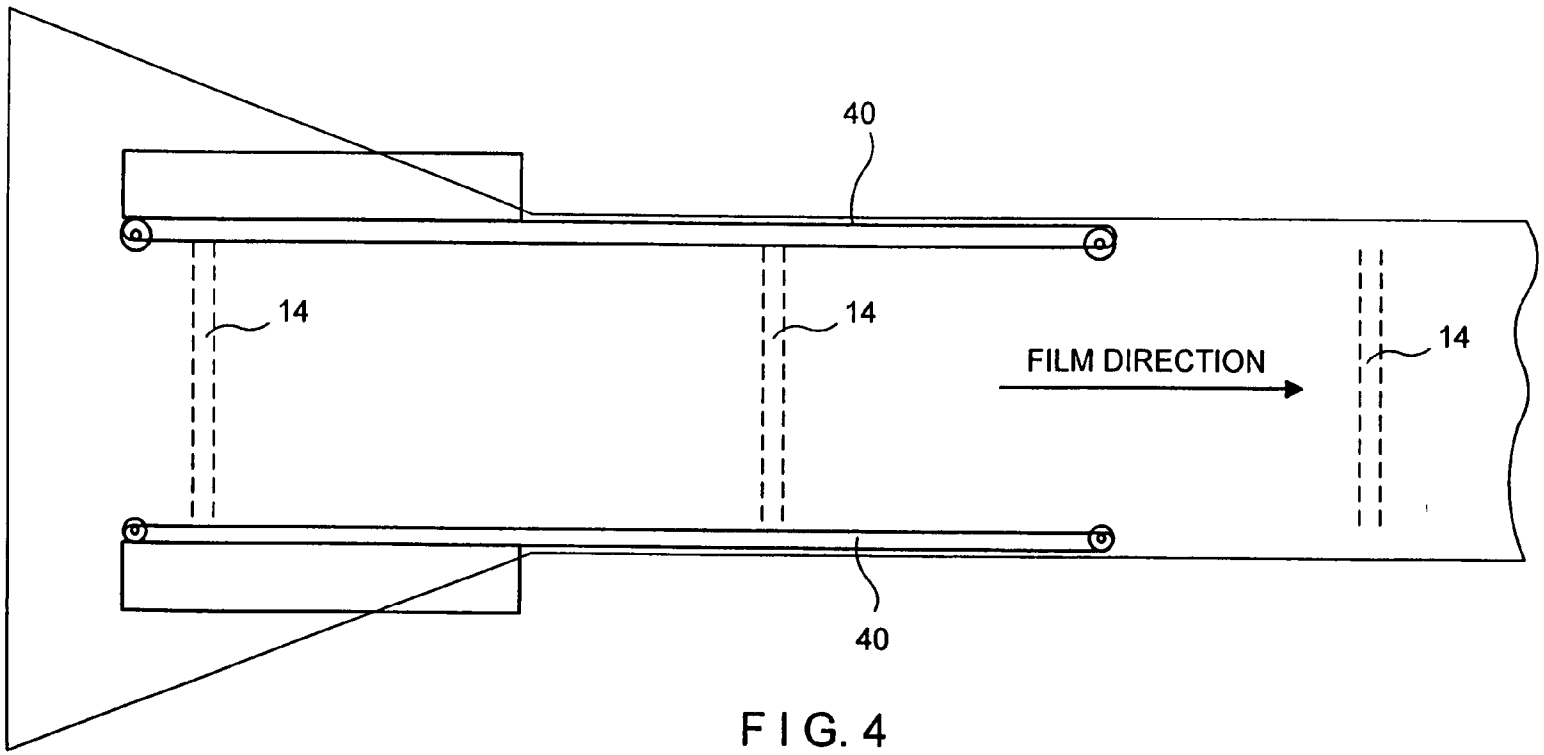
FIG. 4 is top plan view of the packaging film flowing through the forming box section of the horizontal form, fill and seal machine.
Figure 6:
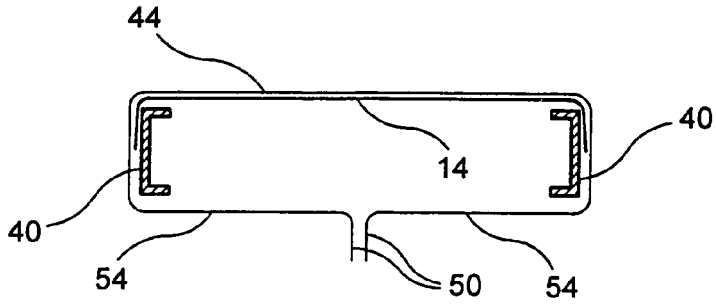
FIGS. 6–9 are views similar to FIG. 5 depicting the folding of the film about alternative guide bars.
Figure 7:
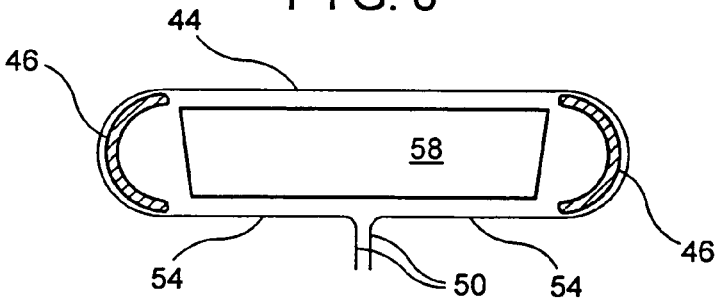
Figure 8:
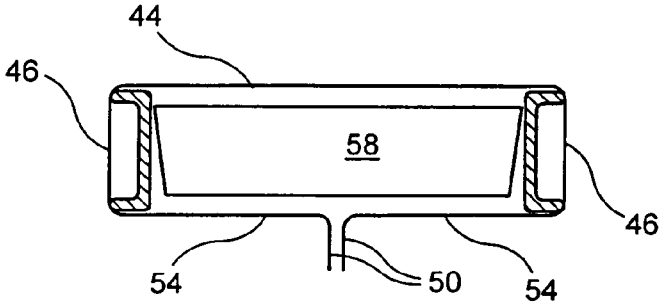
Figure 9:
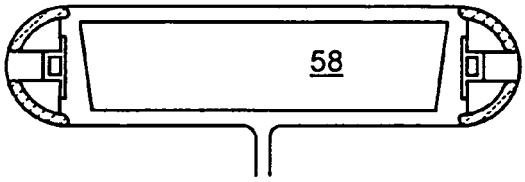
Figure 10:
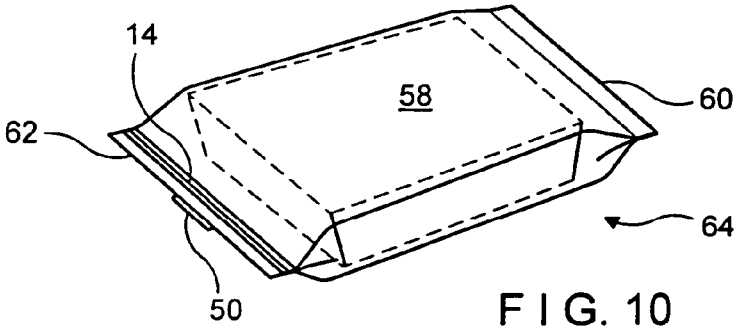
FIG. 10 is a perspective view of a bag made in accordance with the method and on the apparatus of the present invention and filled with product.

Referring to FIG. 3, it can be seen that the guide bars 40 are provided with rollers 66 at the ends thereof. The rollers facilitate the film along the guide bars. To this end, the guide bars may be coated with Teflon or a ceramic to facilitate film movement. Likewise the bars may be grooved or knurled to facilitate the film flow over the bars. In FIG. 5 the guide bars 40 are arcuate. Alternative shapes for the guide bars are depicted in FIGS. 6–9. In each case the height of the package 64 is determined by the height of the guide bars and the width (from side to side of the package) is determined by the thickness of the guide bars.

Thus, in accordance with the above, the aforementioned objectives are effectively attained.

Having thus described the invention, what is claimed is:

1. A method of forming packaging on a horizontal form, fill and seal machine comprising:

moving a sheet of packaging film longitudinally from a film supply to a forming box, said forming box having an open inlet end, an open outlet end, a top, opposed side walls and a pair of guide bars respectively outwardly adjacent from said side walls extending in a downstream direction from said outlet end; and guiding a longitudinal center portion of said packaging film about the exterior of said forming box top and guiding longitudinal side marginal portions of said film by said guide bars and onto a conveyor to form a product receiving film surface on said conveyor; and wherein said conveyor includes two portions with a longitudinal slit therebetween comprising the further step of feeding longitudinal edges of said packaging film marginal portions passing through said slit and sealing said longitudinal edges together to form an envelope while said film is guided by said guide bars.

2. The method in accordance with claim 1 wherein said conveyor extends to a sealing station downstream of free ends of said guide bars, said forming box is inclined with respect to said conveyor with said inlet end above said outlet end, and comprising the further step of feeding product through said forming box onto said product receiving surface.

3. The method in accordance with claim 1 comprising the further step of forming spaced cross seals along said envelope transversely joining a top portion of said envelope to a bottom portion of said envelope.

4. The method in accordance with claim 3 wherein product is intermittently deposited on said product receiving surface and a cross seal is formed after each deposit of product.

5. The method in accordance with claim 1 comprising, at a location between said packaging film supply and said forming box, the further step of attaching a strip of zipper to said packaging film.

6. The method in accordance with claim 5 wherein said strip of zipper is attached to said packaging film transverse to the direction of longitudinal movement of said packaging film.

7. The method in accordance with claim 5 wherein said zipper is attached to said packaging film in the direction of longitudinal movement of said packaging film.

* * * * *